United States Patent [19]

Noble et al.

[11] 4,091,563

[45] May 30, 1978

[54] FIGHTING DOLL AND FIGHT RING WITH DOLL MANIPULATOR

[76] Inventors: Sidney Noble, 100 Warren Rd., West Orange, N.J. 07052; Patrick Luke, 184 Nga Tsin Wai Rd., E-4, Kowloon, Hong Kong

[21] Appl. No.: 739,783

[22] Filed: Nov. 8, 1976

[51] Int. Cl.[2] ..... A63H 13/06

[52] U.S. Cl. ..... 46/142; 46/17; 273/85 D; 273/85 F

[58] Field of Search ..... 46/142, 143, 145, 32, 46/126, 17; 273/85 B, 85 D, 85 F

[56] References Cited

U.S. PATENT DOCUMENTS

| | | | |
|---|---|---|---|
| 592,567 | 10/1897 | Kleemichen | 46/142 |
| 2,466,214 | 4/1949 | Deaton | 46/126 X |
| 2,760,306 | 8/1956 | Pelletier | 46/142 |
| 2,832,174 | 4/1958 | Yip | 46/142 X |
| 3,852,911 | 12/1974 | Sapkus et al. | 46/126 |
| 3,874,112 | 4/1975 | Sapkus et al. | 46/142 X |
| 3,927,883 | 12/1975 | Bosley et al. | 273/85 B |

FOREIGN PATENT DOCUMENTS

| | | | |
|---|---|---|---|
| 1,029,135 | 3/1953 | France | 273/85 F |
| 1,245,682 | 10/1960 | France | 273/85 F |
| 694,083 | 7/1940 | Germany | 46/126 |

*Primary Examiner*—F. Barry Shay

*Attorney, Agent, or Firm*—Kirschstein, Kirschstein, Ottinger, Frank & Cobrin

[57] ABSTRACT

A fighting toy doll and the combination of a fighting doll and a toy prizefight ring. The doll is provided with appurtenances and mounting so that the doll falls down onto the floor of the ring when appropriately struck by an opponent doll. The fighting doll and ring combination has a swivel mounting for the doll which is rotatably and slidably mounted on a corner post of the ring so that the doll may readily be manually moved about to all parts of the ring. The toy prizefight ring has features of structural design which facilitate assembly of the toy. The fighting doll is provided with internal structure so that movement of the arms, and also the legs in combination with the arms, is readily attained by the insertion of a linear actuator into an opening in the lower torso of the doll, which linear actuator is usually a member of the supporting assembly by which the doll is manually moved about in the ring.

9 Claims, 10 Drawing Figures

FIG. 7
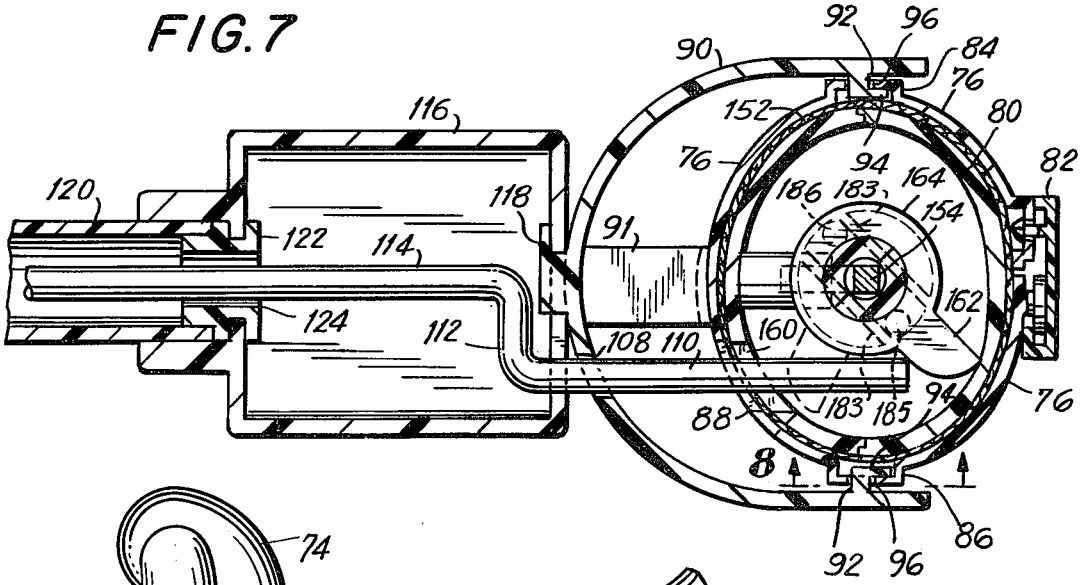
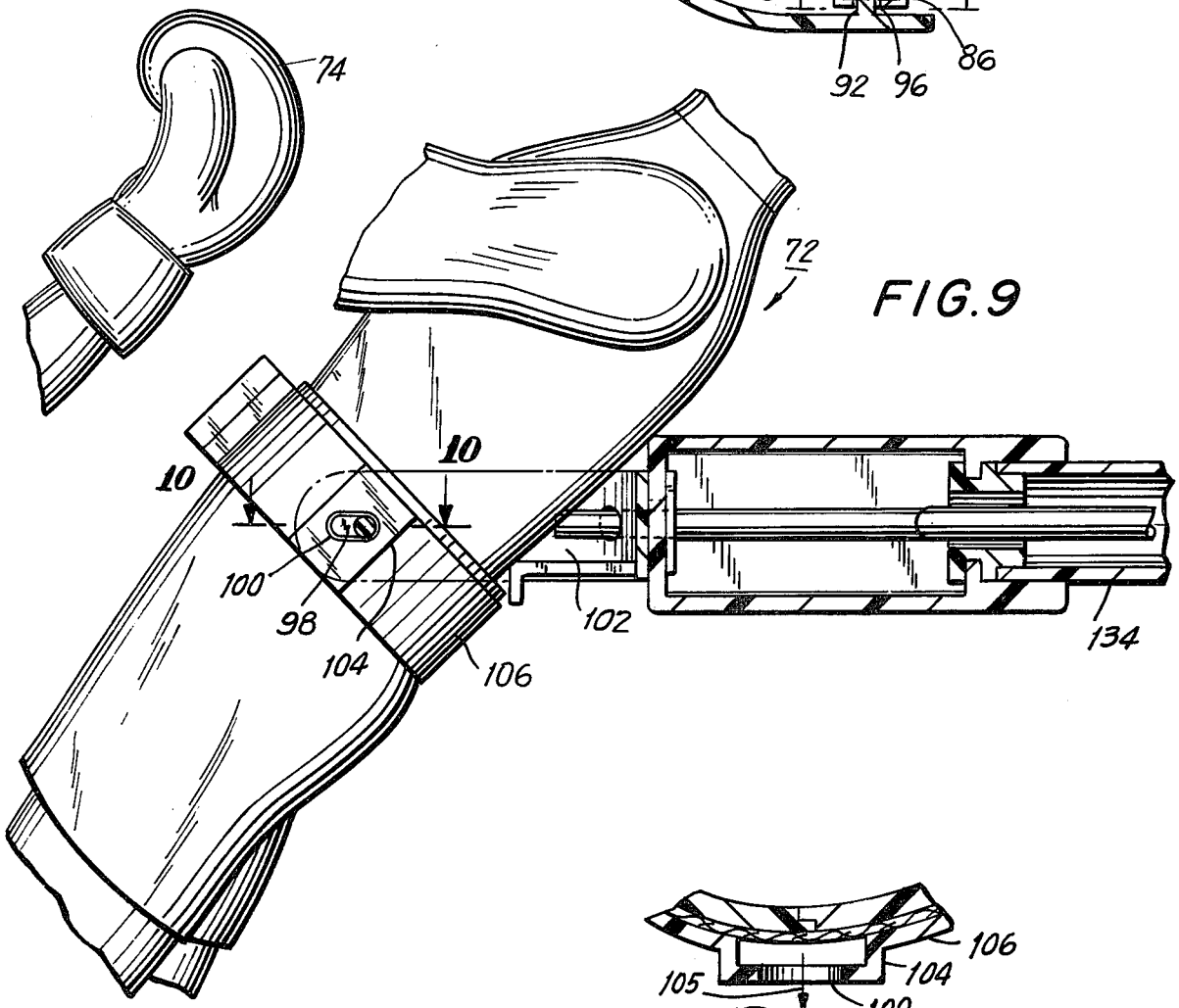
FIG. 9
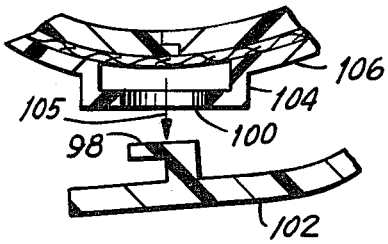
FIG. 10

FIGHTING DOLL AND FIGHT RING WITH DOLL MANIPULATOR

CROSS REFERENCE TO RELATED APPLICATION

The present application is an improvement relative to the fighting doll described in U.S. patent application Ser. No. 601,090 filed Aug. 1, 1975, now U.S. Pat. No. 4,003,158 issued Jan. 18, 1977.

BACKGROUND OF THE INVENTION

1. Field of the Invention

The invention relates to a fighting doll toy.

2. Description of the Prior Art

Fighting dolls are very attractive toys for children, especially for young boys. Such dolls are especially attractive when the head of the doll is a simulation of the likeness of a well-known boxing champion. The provision of structure and means so that the partially rotatable or pivoted members of the doll may be appropriately manually manipulated to simulate boxing movements, has made such dolls of great interest in recent years because of significant commercial possibilities and large-scale retail sales.

Dolls with movable body members are described in U.S. Pat. Nos. 525,716; 3,648,405; 3,672,097; 3,758,982; 3,786,596 and 3,858,353 and Italian Pat. No. 672,206.

SUMMARY OF THE INVENTION

1. Purposes of the Invention

It is an object of the present invention to provide an improved fighting doll.

Another object is to provide an improved toy prizefight ring for a fighting doll.

A further object is to provide improved structure for mounting a fighting doll in a toy prizefight ring, and for moving such a doll about in the ring so that when the fighting doll is struck by an opponent doll, the fighting doll will readily be dislodged from support appurtenances and will fall down in the ring.

An additional object is to provide a fighting doll with improved internal apparatus to simulate boxing movements.

Still another object is to provide a toy prizefight ring which may be readily assembled into a rigid configuration.

An object is to provide both a fighting doll and a toy prizefight ring for the doll which may be inexpensively manufactured, i.e. made of relatively simple components which are readily assembled into the finished product.

An object is to provide a fighting doll, and such a doll in combination with a toy prizefight ring, which will effectively simulate an actual prizefighter and a boxing match in a ring, and which will thus be greatly attractive to and provide amusement for children of all ages, and especially for young boys.

These and other objects and advantages of the present invention will become evident from the description which follows.

2. Brief Description of the Invention

There are several salient inventive aspects of the fighting doll of the present invention, especially with regard to the doll in combination with a toy prizefight ring having unique features, both per se and also relative to the doll. At the onset, in order to accurately simulate a prizefight match with an opponent doll, the fighting doll is preferably provided with a detachable mounting, so that the fighting doll is supported in an upright position until angularly displaced by a blow from the opponent doll directed against the upper portion of the fighting doll. When this occurs, the fighting doll, being angularly displaced, is automatically detached from the mounting and falls to the floor of the ring, thus simulating a knockout.

The detachable mounting entails the provision of a belt which encircles the waist of the fighting doll and which is provided with two opposed side protrusions which extend outwards from the surface of the doll. Each protrusion thus forms a recess. Each recess has a slot, and each slot is inclined at an acute angle from vertical, with the upper end of each slot being towards the back of the belt. A generally semicircular resilient clamp is provided, with the doll being mountable on the clamp. Adjacent each end of the horizontally oriented clamp is an inner protrusion and a generally horizontal arm, with each arm extending from the inner end of a protrusion towards an end of the clamp, so that each arm fits through a slot in a recess when the doll is inclined from the vertical with the lower end of the doll away from the clamp and with the resilient clamp being stressed so that the ends of the clamp converge. Thus the doll is again raised to an upright position, with each arm in its respective recess and the protrusion extending through the slot. The linear distance between the arms is however greater than the linear distance between the slots when the ends of the resilient clamp are not displaced towards each other by manual deformation of the resilient clamp. Generally horizontally oriented support means extends rearwards from the horizontally oriented clamp, so that the fighting doll is supported in an upright position until angularly displaced by being struck by a blow from an opponent doll directed against the upper portion of the fighting doll. When this occurs, the arms of the clamp move outwards from the slots and the resilient clamp springs to a non-deformed condition with the ends of the clamp spaced from the belt, so that the fighting doll falls downwards from the clamp and onto the floor of the toy prizefight ring.

The slot in each recess will generally be inclined at an angle in the range of about 30° to about 60° from vertical, and will preferably be inclined at an angle of about 45° from vertical. In addition, the ends of each slot and the ends of each arm will preferably be rounded to facilitate ingress and egress of the arm into and out of the recess.

Another inventive aspect of the fighting doll involves the doll in combination with a toy prizefight ring, the combination entailing structure so that the fighting doll is disposed within the ring and is manually movable about substantially the entire upper surface of the floor of the ring. The toy prizefight ring has a square planar horizontal floor, four vertical corner posts, and a plurality of horizontally oriented and spaced apart linear rail members, each of the rail members extending between two adjacent corner posts, so that the toy prizefight ring simulates an actual full-scale prizefight ring in which boxing contests are held. The upper end of at least one of the posts has a central vertical cylindrical recess. A horizontal cylindrical rod is provided, and a cylindrical sleeve is slidably mounted on the rod. The cylindrical sleeve has a cylindrical protrusion which is slidably fitted vertically downwards into the recess in the upper end of the post. A handle or the like is provided at the outer end of the rod so that the rod may be manually grasped, and may thus be both manually swivelled about the corner post as the protrusion rotates within the recess, and also concomitantly or alternately horizontally displaced inwards or outwards relative to the ring. The fighting doll is mounted on the inner end of the rod, and thus the doll may be manually positioned at virtually any point on the upper surface of the floor of the ring by manipulation of the rod. Since the rod and sleeve are cylindrical, the doll may also be concomitantly inclined at will sideways from a vertically upright position by manipulation, i.e. partial rotation, of the rod about its central horizontal axis, so as to simulate the ducking, bobbing and weaving of an actual boxer during a prizefight.

In addition to the manipulation of the entire doll per se by means of the rod, i.e. in addition to the manual positioning and inclining of the entire doll within the ring by appropriate movement of the rod, in a preferred embodiment, structure and means are provided in conjunction with the doll and ring, so that at least one limb of the fighting doll may be concomitantly moved to simulate actual boxing movements of the arms and/or the legs of a prizefighter. In this embodiment of the invention, the rod is hollow and a linear shaft extends through the rod. The handle or other means at the outer end of the rod to manually grasp the rod includes means such as an external trigger and an internal leaf spring, to displace the shaft within the rod alternately towards and away from the fighting doll. The inner end of the shaft is contiguous to and cooperates with suitable means within the fighting doll, e.g. a cammed internal lever or external pin cooperating with an internal shaft, gears etc. within the doll, so that at least one limb of the fighting doll is moved when the shaft is manually displaced alternately towards and away from the fighting doll. Thus, in the present invention, the simulation of an actual prizefight is complete. The means within the fighting doll to move a limb preferably moves both of the doll legs and/or both of the arms; as will appear infra, the legs alternately pivot forwards and backwards in a preferred embodiment, and the arms are rotated in a fighting motion relative to the upper torso of the doll. It is preferred that the upper end of each of the four corner posts be provided with a central vertical cylindrical recess, so that both the fighting doll and an opponent doll may be appropriately oriented and manipulated within the toy prizefight ring by the provision of a rod and appurtenances thereto for each doll.

The toy prizefight ring per se of the present invention is also provided with novel features. The ring, in addition to being of the usual external configuration to simulate an actual prizefight ring, is preferably provided with structure so that it may be readily assembled even by a child, and so that a rigid configuration is attained which is not readily broken or distorted even by an active child. The toy prizefight ring thus preferably includes a square planar horizontal floor, four vertically oriented cylindrical corner posts, and a plurality of horizontally oriented and spaced apart linear rail members, with each of the rail members extending between two adjacent corner posts. The lower end of each corner post extends downwards through a cylindrical fitting which extends downwards from a corner of the floor of the ring, and each fitting is provided with an upper perimetral notch or keyway at the section of the fitting closest to the center of the ring. Each corner post is provided with a flange adjacent its lower end, together with a key, which key depends from the flange into the notch or keyway of the fitting, so that the key is oriented towards the center of the ring.

In order to rigidly mount the corner posts in the corner holes, the lower end of each corner post is provided with inner female screw threading, and a lower cap is provided for each corner post. Each cap has an upwardly extending central cylindrical protuberance having an outer male screw threading, so that a cap is screwed upwards into the lower end of each corner post to mount each corner post on the floor, with restraint and rigid emplacement of each corner post being attained by cooperation between a post flange above the floor and a cap below the floor, which cap is screwed upwards against the fitting which depends from the corner of the floor.

At least one hollow receptacle for an end of rail members extends outwards from each corner post above the key. Each receptacle is provided with opposed lateral openings, each of which has a wide circular upper portion and a narrow linear vertical lower portion. Each end of each of the linear rail members has a narrow curved extension and a terminal head, the head being narrower than the circular upper portion of a lateral opening in a receptacle and wider than the lower portion of a lateral opening in the receptacle, so that each linear rail member is mountable between two adjacent corner posts by inserting each terminal head through a respective circular upper portion of a lateral opening and into a hollow receptacle of a corner post, and displacing the linear rail member downwards so that each narrow curved extension extends through the lower portion of a lateral opening in the hollow receptacle.

The central axis of each terminal head portion of a linear rail member is preferably at about a 45° angle with respect to the central axis of the linear rail member. In accordance with the usual configuration of a prizefight ring, three vertically aligned and spaced apart hollow receptacles are provided for each corner post, so that three parallel and spaced apart linear rail members extend between each pair of adjacent corner posts. Each bottom cap for a post will preferably be circular and will be provided with a lower diametral ridge to facilitate screwing the cap upwards into the lower end of the corner post. In a preferred embodiment, the narrow linear vertical lower portion of each receptacle is provided with a detent, so that the end of the linear rail member may be snapped in place and securely held within the receptacle.

Finally, improvements in the internal structure of the fighting doll per se have been devised. The fighting doll of the present invention, when manipulated by the shaft described supra, or by like means, effectively simulates the fighting motion of the arms and/or the legs of an actual boxer. With regard to simulation of the fighting motion of the arms of the fighting doll, this result per se has been accomplished by prior dolls, e.g. the doll of the U.S. patent application mentioned supra, however in the present invention, improved structural elements and features are provided in this regard, which provide a more realistic simulation and which are simpler and more reliable in service.

The present fighting doll thus is provided with a lower torso having dependent legs and an upper torso pivotably mounted to the lower torso, with the upper torso being partially rotatable about a central vertical axis and having rotatably mounted arms, each of the arms having an inner longitudinal shaft extending to an inner pinion gear. A central generally vertical shaft is provided within the upper and lower torsos. The shaft extends upwards from a lower end fixed to the lower torso, to an upper central crown gear meshed with the inner pinion gears of the arms. Also within the doll is an annular actuation member rotatably mounted on the central vertical shaft. The upper end of this actuation member or means is fixed to the upper torso, and the lower end of the actuation member or means is within the lower torso and has a lever. The lower torso is provided with a rear opening adjacent to the lever, so that the annular actuation member is partially rotatably by a linear actuator manually inserted into the lower torso through the opening to move the lever. Such linear actuator typically is the horizontal shaft within the hollow horizontal cylindrical rod, as described supra, or any other suitable linear horizontal member which may be manipulated into and out of the opening in the doll's lower torso.

In any event, the result of the partial rotation of the annular actuation member about the central vertical shaft is that the upper torso is pivoted relative to the lower torso, i.e. the upper torso is partially rotated about a central vertical axis while the lower torso remains stationary. This results in a partial rotation of the pinion gears because of movement of the upper torso relative to the stationary crown gear, so that the arms are thereby rotated in a fighting motion relative to the upper torso. Inner spring biasing means are provided within the upper torso, which biasing means extends between the central vertical shaft and the upper torso, so that the upper torso and the arms return to a previous fixed fighting stance position, with the upper torso pivoting back to alignment with the lower torso, upon manual withdrawal of the linear actuator.

The legs which depend from the lower torso of the doll may also be movable, in a preferred embodiment of the invention. To accomplish this new result, the dependent legs are rotatably mounted to the lower torso, the annular actuation member is provided with a lower camming surface, and a projection extends upwards to the lower camming surface from the rotatably mounting of each leg, so that partial rotation of the annular actuation member pivots each leg about its respective rotatable mounting.

The fighting doll and toy prizefight ring of the present invention provides several salient advantages. The doll, and the doll in combination with the ring, effectively simulates an actual prizefighter and a boxing match in an actual prizefight ring, and thus the invention provides a great deal of enjoyment for children and provides much amusement and interest for those playing with the toy, which is especially the case with young boys. The fighting doll and toy prizefight ring for the doll may be inexpensively manufactured, and are made of relatively simple components which are readily assembled, even by a child, into the finished toy. The fighting doll has improved internal apparatus which effectively simulates boxing movements and which is rugged and not easily broken in service. Similar considerations apply to the toy prizefight ring, i.e. it is readily assembled into a rigid configuration. In the preferred embodiment of the invention, wherein when the fighting doll is struck by an opponent doll, the fighting doll is dislodged from the support clamp and falls down in the ring, further simulation of a boxing match end result is attained and thus the toy provides complete satisfaction for children of all ages.

The invention accordingly consists in the features of construction, combination of elements, and arrangement of parts which will be exemplified in the device hereinafter described and of which the scope of application will be indicated in the appended claims.

BRIEF DESCRIPTION OF THE DRAWINGS

In the accompanying drawings in which is shown one of the various possible embodiments of the invention;

FIG. 7 is a partial sectional plan view taken substantially along the lines 7—7 of FIG. 4;

FIG. 9 is a partial sectional elevation view taken substantially along the lines 9—9 of FIG. 1; and FIG. 10 is a partial sectional plan view taken substantially along the lines 10—10 of FIG. 9

DETAILED DESCRIPTION OF THE PREFERRED EMBODIMENTS

Figure 1:
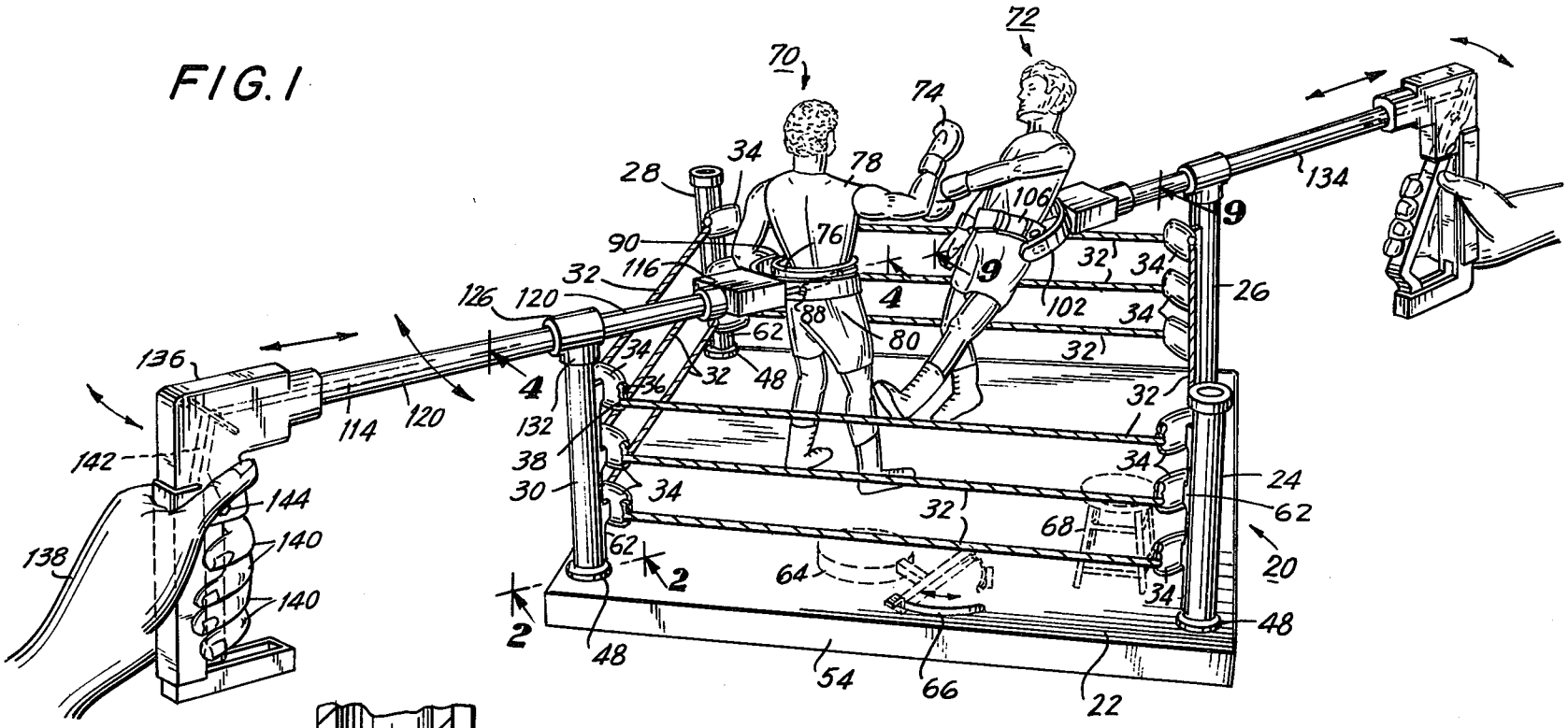
FIG. 1 is a perspective view of an entire fighting doll, opponent doll, and toy prizefight ring assemblage in service and being manipulated.
Figures 4, 5, 6, 8:
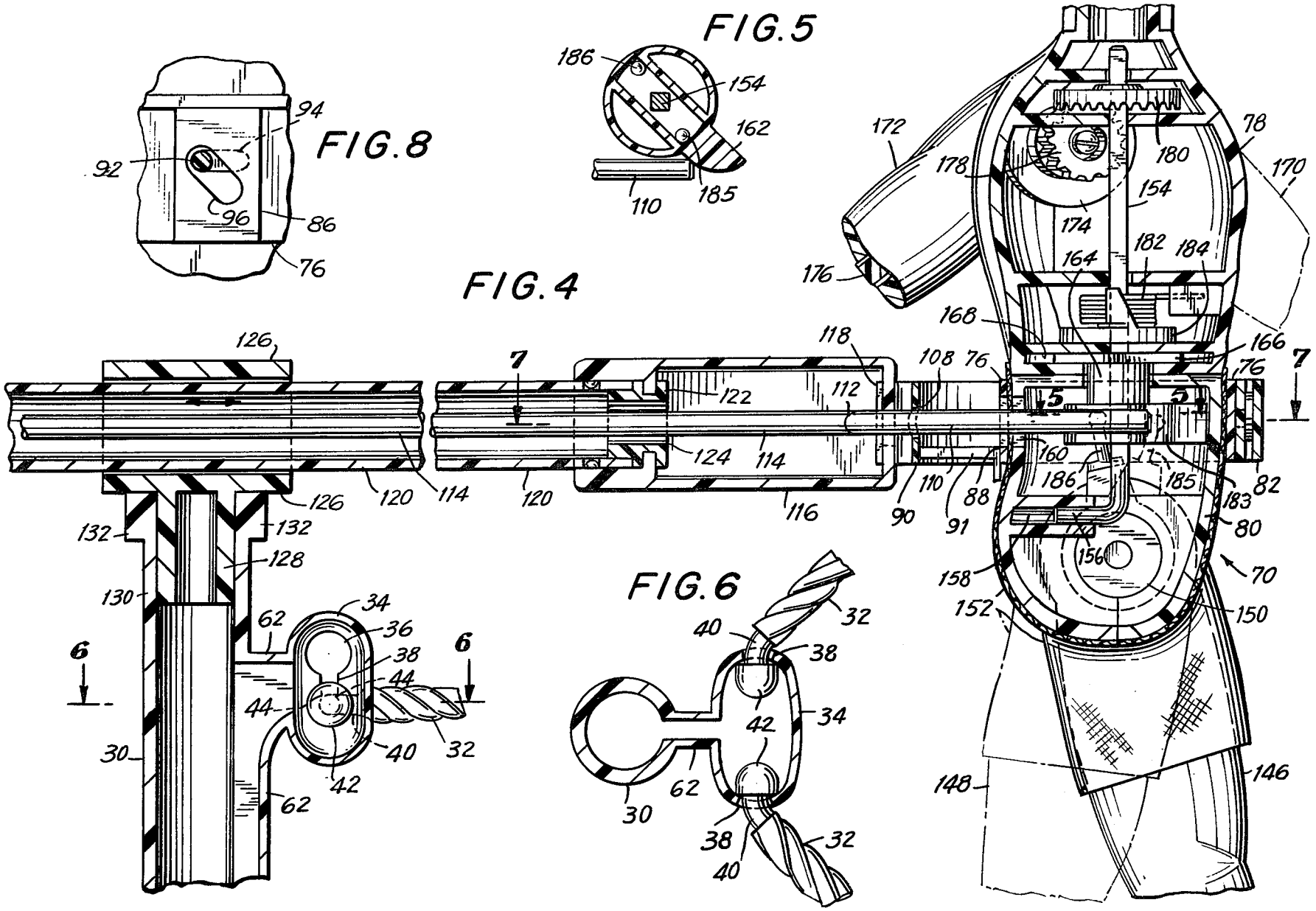
FIG. 4 is a sectional elevation view taken substantially along the lines 4—4 of FIG. 1.
FIG. 5 is a partial sectional plan view taken substantially along the lines 5—5 of FIG. 4.
FIG. 6 is a sectional plan view taken substantially along the lines 6—6 of FIG. 4.
FIG. 8 is a partial sectional elevation view taken substantially along the lines 8—8 of FIG. 7.

Referring now to FIG. 1, a toy prizefight ring 20 is provided with a planar square horizontal floor 22, four vertically oriented corner posts 24, 26, 28 and 30, and a plurality of generally identical horizontally oriented and spaced apart linear rail members 32. Each of the linear rail members 32 extends horizontally between two adjacent corner posts, and specifically between two hollow receptacles 34 mounted on adjacent corner posts. Each of the hollow receptacles 34 extends outwards from a corner post towards the center of the ring, and as best shown in FIGS. 4 and 6, each receptacle 34 is provided with opposed lateral openings, each opening having an upper wide circular portion 36 and a narrow linear vertical lower portion 38. Each end of each of the linear rail members 32 is provided with a narrow curved extension 40 and a terminal head 42, as best shown in FIG. 6. The head 42 is narrower than the opening portion 36 and wider than the opening portion 38, so that each linear rail member 32 is mounted between two adjacent corner posts such as 30 and 24 by inserting each terminal head 42 through a respective upper opening portion 36 and into a hollow receptacle 34, and displacing the linear rail member 32 downwards so that each narrow curved extension 40 extends through the lower opening portion 38. Each narrow linear vertical lower portion 38 of an opening in a receptacle 34 is preferably provided with one or more detents 44, as shown in FIG. 4, so that the end of the rail member 32 snaps into place and is firmly and rigidly emplaced, in order to provide a rigid assemblage of the ring 20.

Figure 2:
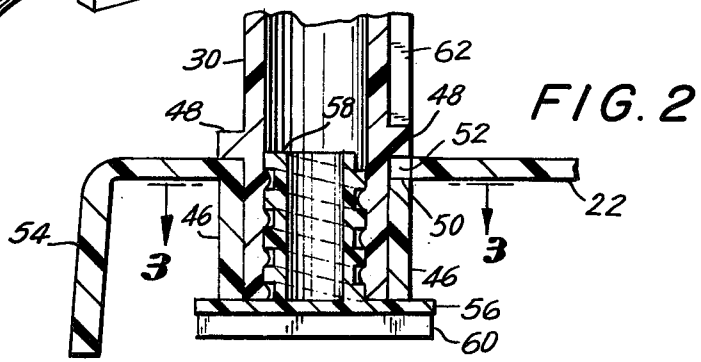
FIG. 2 is a partial sectional elevation view taken substantially along the lines 2—2 of FIG. 1.
Figure 3:
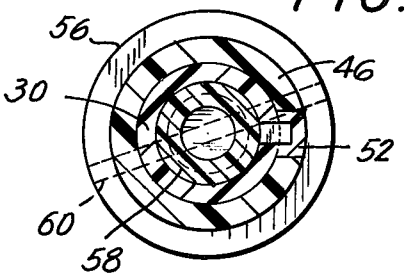
FIG. 3 is a sectional plan view taken substantially along the lines 3—3 of FIG. 2.

Each corner post of the ring 20 is also firmly emplaced by means of structure best shown in FIGS. 2 and 3. The lower end of each corner post extends downwards through a cylindrical fitting 46 which depends from a corner of the floor 22. Further downwards movement of each corner post is prevented by the provision of a flange 48 adjacent the lower end of each corner post.

Referring to FIG. 2, each fitting 46 is provided with an upper perimetral notch or keyway 50, which notch 50 is oriented at the section of the fitting closest to the center of the ring 20, i.e. on a diagonal of the ring 20. A key 52 depends from the flange 48 into the notch 50, so that the key 52 is oriented towards the center of the ring 20 and each corner post is properly aligned, with the receptacles 34 extending outwards from each corner post above the key so that the receptacles 34 are properly aligned facing towards the center of the ring. Referring to FIGS. 1 and 2, a baffle 54 depends from the periphery of the floor 22 to mask the fitting 46 from the view of the child playing with the toy. In order to prevent the corner posts from falling out of a fitting 46, as when the toy is stored or is tilted by a child, as shown in FIG. 2 the lower end of each corner post is provided with inner female screw threading, and a lower cap 56 is provided for each corner post. The cap 56 has an upwardly extending central cylindrical protuberance 58, and the protuberance 58 has outer male screw threading, so that the cap 56 is screwed upwards into the lower end of the corner post 30 (FIG. 2) and against the fitting 46, so that each corner post is firmly emplaced in a corner of the floor 22 because of the respective downwards and upwards pressure of the flange 48 and cap 56 against, respectively, the floor 22 and the fitting 46. The cap 56 is preferably circular, as shown in FIG. 3, and in order to facilitate emplacement of the cap 56 by upwards screwing, the cap 56 is preferably provided with a lower diametral ridge 60, shown in FIG. 2 and also shown in phantom outline in FIG. 3.

Various appurtenances of the ring 20 may be mentioned. The receptacles 34 may be directly attached to the corner posts, however to more accurately simulate an actual prizefight ring, each group of three receptacles 34 are mounted on a corner post by means of a bracket 62; and also in order to complete the illusion of an actual boxing ring, three receptacles 34 are provided in vertical alignment for each corner post since the customary number of ropes in actual rings is three. The toy ring is preferably provided with bell 64 (FIG. 1) mounted below the floor 22, together with a lever 66 above the floor 22 which is moved to sound the bell thus marking the beginning or end of a round of the boxing match, as is the case with an actual prizefight. Toy stools such as stool 68 may be provided to complete the resemblance to an actual prizefight ring.

The fighting doll and appurtenances thereto will now be described. Referring to FIG. 1, a fighting doll 70 has delivered a blow to an opponent doll 72 by means of a right-handed blow from gloved hand 74, and the opponent doll 72 is shown in an inclined position ready to fall to the floor 22. Both of the dolls 70 and 72 are equipped with structure and means to simulate fighting motion of the arms and legs; detachable mounting structure and means so that a doll which has received a blow and becomes inclined i.e. the doll 72, will fall to the floor 22 of the ring 20; and structure and means so that each doll when upright is manually displaceable about the entire upper surface of the floor 22 and may be concomitantly inclined sideways from a vertically upright orientation, so as to accurately simulate the bobbing, weaving, ducking, twisting and other action movements of an actual prizefight boxer.

Referring to the doll 70, a belt 76 encircles the waist of the doll, between an upper torso 78 and a lower torso 80. The belt 76 is generally disposed somewhat below the middle of the doll and may totally encircle only the lower torso 80 in suitable instances. The belt 76 is removable from the doll 70 and is furnished with a front clasp 82, as shown in FIGS. 4 and 7. The belt 76 as shown in FIG. 7 has two opposed side protrusions 84 and 86 which define recesses and which extend outwards from the surface of the doll 70. In addition, the belt 76 is provided with a rear opening 88, best shown in FIGS. 4 and 7, to accommodate a horizontal linear actuator, which as will appear infra extends into the doll 70 from external manual manipulation means.

A generally semi-circular clamp 90, best shown in FIGS. 4 and 7, is detachably attached to the belt 76, and spaced from the belt 76 by a central spacer 91. The clamp 90 is composed of a suitable resilient, i.e. deformable, material such as a suitable plastic e.g. polyethylene, polypropylene or the like, and adjacent each end of the clamp 90, an inner protrusion 92 (FIG. 7) and a generally horizontal arm 94 are provided. Each arm 94 extends from an inner end of a protrusion 92 towards an end of the clamp 90. When the doll such as doll 70 is in a vertically oriented disposition, each arm 94 is disposed within a recess of a protrusion 86 and each protrusion 92 extends inwards through an inclined slot 96 which is provided in each protrusion 86. Each slot 96 is inclined at an acute angle from vertical (FIG. 8), with the upper end of each slot being towards the back of the belt 76. This disposition of the clamp 90 allows the doll 70 to be manually maneuvered about the ring 20 by generally horizontal support means to be described infra which extend rearwards from the clamp 90, so that the fighting doll 70 is supported in an upright position. The clamp 90 has been mounted on the doll 70 by manually deforming the resilient clamp 90 by moving the two ends of the clamp 90 towards each other, inclining the doll 70 from the vertical with the lower end of the doll 70 away from the clamp 90, fitting each arm 94 inwards through a slot 96 in a protrusion 86, and again raising the doll 70 to an upright position. It is necessary that the linear distance between the arms 94 be greater than the linear distance between the slots 96 when the ends of the resilient clamp 90 are not displaced towards each other by manually deforming the clamp 90, so that the clamp 90 is not detachable from the doll 70 unless and until the doll 70 is angularly displaced by a blow from the opponent doll 72 directed against the upper portion of doll 70, at which time, when the doll 70 is angularly displaced, the arms 94 will move outwards from the slots 96 and the resilient clamp 90 will spring to a non-deformed condition with the ends of the clamp 90 spaced from the belt 76, so that the fighting doll 70 will fall downwards from the clamp 90 and onto the floor 22 of the ring 20.

This sequence of the falling down of a doll from the detachable mounting has been accomplished with regard to the opponent doll 72. In the case of doll 72, as mentioned supra, the doll 72 has received a blow from the right hand 74 of doll 70, and doll 72 is in an inclined position and ready to fall down to the floor 22. As shown in FIGS. 9 and 10, the inclination of doll 72 has resulted in an arm 98 becoming aligned with a slot 100, so that (FIG. 10) the end of a clamp 102 has sprung out of a protrusion 104, as indicated by the arrow 105. Similar considerations apply to the other end of the clamp 102, so that both ends of the clamp 102 are now spaced from belt 106 of the doll 72, and doll 72 is free to fall downwards to floor 22.

Each slot 96 or 100 is generally inclined at an angle in the range of about 30° to about 60° from vertical, with a angle of inclination of about 45° from vertical being preferred as providing optimum simulation of the actual movement of a boxer when struck by a blow from an opponent, and also, because a 45° angle necessitates a substantial blow before the doll will fall; because the moving doll is more firmly held when the angle is about 45°; and finally because the doll is readily emplaced in a clamp when the angle is about 45°. As best shown in FIGS. 8 and 9, the ends of each slot and the ends of each arm are preferably rounded to facilitate ingress and egress of the arm.

Returning now to the doll 70, and referring to FIGS. 4 and 7, the clamp 90 is provided with an opening 108 which is aligned with the opening 88 in belt 76, so as to permit free horizontal movement of a linear actuator or shaft 110 axially towards and away from the doll 70. The linear actuator 110 and openings 108 and 88 are offset to one side of the rear of the doll 70, so that an internal lever to be described infra may be pivoted about the central vertical axis of the doll 70. Actuator 110 actually consists in practice of a linear shaft which extends horizontally rearwards from the doll, which shaft 110 is provided with a perpendicular section 112 (FIG. 7), so that the main section 114 of the shaft extends horizontally rearwards from, essentially, alignment with the central portion of the doll torso, so that centralized manual manipulation of the doll is attained.

Shaft section 112 and the inner end of the conjoint section 114 are disposed within an enclosure 116 so as to permit free horizontal movement of the shaft while masking its actual configuration (see FIG. 1). The enclosure 116 is also part of the main support elements for the doll; enclosure 116 extends rearwards from clamp 90, to which it is attached by attachment 118, to the main support rod 120 by which the doll is held and manipulated about in the ring 20. As shown in FIGS. 4 and 7, an attachment 122 between enclosure 116 and rod 120 is provided with a horizontal opening 124 to accommodate for inwards and outwards movement of the linear shaft section 114 towards and away from the doll 70. Similarly, horizontal rod 120 is concentrically spaced about shaft 114 and the rod 120 is cylindrical to accommodate manual inclination of the doll 70 sideways from the vertical, as will now appear.

Referring now to FIGS. 1 and 4, the horizontal cylindrical rod 120 extends rearwards relative to doll 70, from its attachment 122 to enclosure 116, and through a cylindrical sleeve 126 slidably mounted on rod 120. The sleeve 126 is provided with a dependent cylindrical protrusion 128 (FIG. 4). The protrusion 128 is slidably fitted into a cylindrical recess in the upper portion 130 of corner post 30, which in this case is merely the cylindrical upper portion per se of the hollow cylindrical post 30. The configuration of sleeve 126 and protrusion 128 permits the rod 120 and its forward appurtenances as described supra, including doll 70, to be manually manipulated in the desired fashion by means at the outer of the rod 120, i.e. the doll 70 may be concomitantly or alternately moved towards or away from the center of the ring 20, laterally towards or away from the opponent doll 72, or even fairly close to corner post 26, provided that the opponent doll 72 is manually displaced to a position immediately adjacent to post 26. In other words, doll 70 may thus be manually displaceable about virtually the entire upper surface of the floor 22 and may be concomitantly inclined sideways from a vertically upright orientation, since the cylindrical rod 120 may be concomitantly or alternately manually swivelled about the corner post 30, horizontally displaced inwards or outwards relative to the ring 20, and/or rotated about its central horizontal axis. Because the stress of these actions and motions, and the entire weight of rod 120 and its appurtenances, is concentrated at the upper end of post 30, the post 30 will usually be provided with an external shoulder 132 at its upper end, to serve as a reinforcement and to prevent the upper end of post 30 from being overly stressed and broken. In this preferred embodiment of the invention and as shown (FIG. 1) each corner post is provided with an upper central cylindrical recess i.e. each corner post is hollow, both to conserve material of construction (plastic) and also in order to permit the positioning of the dolls 70 and 72 as desired, relative to the bell 64, and also so that the toy may continue to be usable even if one corner post is broken, merely by shifting the dolls and associated rods, i.e. doll 70 and its rod 120, and doll 72 and its rod 134, to mounting on the other corner posts 24 and 28. In this regard, it is evident that in this preferred embodiment of the invention, the doll 72 is provided with a rod 134 and appurtenances thereto which are identical, both structurally and functionally, to the rod 120 and its appurtenances. It is of course within the scope of the present invention to provide a doll such as doll 72 with a portable clamp, i.e. a clamp which is held by a simple hand grip, together with a linear actuator, so that a doll such as doll 72 may be held by hand and moved about in the ring 20, not only as described supra but also vertically upwards and downwards relative to the floor 22.

The rod assemblage is completed, in a broad sense, by the provision of any suitable means at the outer end of the rod 120 to manually grasp and manipulate the rod 120. In this preferred embodiment of the invention, the outer end of rod 120 is provided with a pistol-type grip 136 which is grasped by a hand 138. Squeezing of the pistol grip 136 by movement of fingers 140 towards the palm of hand 138 serves to displace a spring-biased lever 142 about pivot 144 so that shaft section 114 is moved towards the doll 70, which of course moves linear actuator 110 further into the doll, which as will appear infra, serves to provide motion to the arms and/or the legs of the doll 70 by displacement of an internal lever within the doll 70, to be described infra. It will be evident that any horizontal manual displacement of grip 136, either towards or away from the ring 20, or laterally, will serve to displace the doll 70 within the ring 20, as described supra. In addition, grip 136 may be manually partially rotated about an upper horizontal axis, to produce a sideways inclination of doll 70 from a vertical orientation, also as described supra.

The internal structure of the doll 70, which structure permits the arms and/or legs of the doll 70 to be moved by linear actuator 110 to simulate fighting motions, will now be described. Referring to FIGS. 4 and 7, the lower torso 80 of the doll 70 is provided with two dependent legs 146 and 148. The legs 146 and 148 are each rotatably mounted to the lower torso 80; a mounting 150 for the leg 146 is shown. To aid in the illusion of a boxer in a prizefight ring, the lower torso 80 is provided with detachable cloth boxing trunks 152.

The upper torso 78 is pivotably mounted to the lower torso 80. This mounting is accomplished by the provision of a central generally vertical shaft 154 within the upper and lower torsos. The vertical shaft 154 extends upwards from a lower end 156 which is fixed to the lower torso 80, typically by being disposed in a recess 158 provided in the lower torso 80. The upper torso 78 is partially rotatable about the central vertical axis defined by the shaft 154. The pivoting or partial rotation of the upper torso 78 is accomplished by the linear actuator 110. This actuator 110 extends horizontally into the lower torso 80 of the doll 70 through a rear opening 160 in the lower torso 80. As described supra, the actuator 110 is manually displaceable forwards and further into the doll 70 by manual manipulation of the pistol grip 136 (FIG. 1). When this occurs, the actuator 110 contacts and moves a lever 162 (FIG. 7) which is fixed to a sleeve 164. This sleeve 164 is rotatably mounted on the shaft 154 and extends upwards to attachment to a plate 166 which is disposed in a horizontal channel 168 within the upper torso 78, so that when the lever 162 is moved by manipulation of linear actuator 110, the sleeve 164 rotates causing the rectangular, e.g. square, plate 166 to rotate. Since the plate 166 is snugly fitted into a generally square channel 168, the upper torso pivots relative to the lower torso. The combination of elements 162, 164 and 166 constitutes, broadly, annular actuation means rotatably mounted on the central vertical shaft 154, with the upper end of the actuation means, e.g. plate 166, being fixed to the upper tors 78, and the lower end of the actuation means being within the lower torso 80 and having a lever 162.

The upper torso is provided with rotatably mounted arms 170 and 172. The rotatable mounting 174 of arm 172 is shown in FIG. 4. Each arm is provided with an inner longitudinal shaft such as shaft 176 of arm 172. Shaft 176 extends to an inner pinion gear 178 within the upper torso 78. A similar shaft and pinion gear arrangement, not shown, is provided for the arm 170. The inner pinion gears such as gear 178 mesh and cooperate with an upper central generally horizontal crown gear 180 mounted on the upper portion of shaft 154. The pivoting of the upper torso 78 relative to the lower torso 80, as described supra, causes the pinion gears such as gear 178 to be partially rotated by movement of the upper torso 78 relative to the crown gear which is stationary, being fixed to the central shaft 154. This causes the arms 170 and 172 to be rotated, i.e. in a fighting motion, relative to the upper torso 78. Finally, a spring biasing element or means 182 extends between a fitting 184 attached to the central shaft 154 within the upper torso 78, and a panel member 186 of the upper torso 78, so that the upper torso 78 and the arms 170 and 172 return to a previous fixed fighting stance position upon manual partial withdrawal of the linear actuator 110 from its direct forwards displacement of the lever 162. The rearwards displacement of actuator 110 is occasioned by manual release of the pressure of fingers 140 against lever 142.

The legs 146 and 148, which as described supra are rotatably mounted on the lower torso 80, are each also pivoted about a respective rotatable mounting by partial rotation of the annular actuation means (elements 162, 164 and 166). This is accomplished by providing lower camming surfaces 183 on the annular actuation means, together with projections 185 and 186, which each extend upwards from the rotatable mounting of a leg, so that the lower camming surfaces 183 displace the projections 185 and 186 when the annular actuation means is partially rotated as described supra, and each leg is thus pivoted about its respective rotatable mounting.

It thus will be seen that there is provided a fighting doll and toy prizefight ring which achieve the various objects of the invention and which are well adapted to meet the conditions of the practical use.

As various possible embodiments might be made of the above invention, and as various changes might be made in the embodiment above set forth, it is to be understood that all matter herein described or shown in the accompanying drawings is to be interpreted as illustrative and not in a limiting sense. Thus it will be understood by those skilled in the art that although preferred embodiments have been shown and described in accordance with the Patent Statutes the invention is not limited thereto or thereby.

Having thus described the invention, there is claimed as new and desired to be secured by Letters Patent:

1. A fighting doll with detachable mounting comprising a fighting doll, a belt, said belt encircling the waist of said fighting doll and having two opposed side protrusions which define recesses which extend outwards from the surface of the doll, each said protrusion having a slot communicating with a respective said recess, each said slot being inclined at an acute angle from vertical with the upper end of each said slot being towards the back of said belt, a substantially semicircular resilient clamp, an inner protrusion and a substantially horizontal arm adjacent each end of said clamp, each said arm extending from the inner end of a said inner protrusion towards an end of the clamp, so that each said arm fits through a said slot for reception in a said recess when the doll is inclined from the vertical with the lower end of the doll away from the clamp, and so that the doll is mountable on the clamp when again raised to an upright position, the linear distance between said arms being greater than the linear distance between said slots when the ends of said resilient clamp are not displaced towards each other by the deforming of said resilient clamp, and substantially horizontal support means extending rearwards from said clamp, so that said fighting doll is supported in an upright position until angularly displaced by a blow from an opponent doll directed against the upper portion of said fighting doll, whereby when said fighting doll is angularly displaced, said arms move outwards from said slots and said resilient clamp springs to an non-deformed condition with the ends of said clamp spaced from said belt, and said fighting doll falls downwards from said clamp.

2. The fighting doll with detachable mounting of claim 1 in which each said slot is inclined at an angle in the range of about 30° to about 60° from vertical.

3. The fighting doll with detachable mounting of claim 2 in which the angle of inclination of each said slot is about 45° from vertical.

4. The fighting doll with detachable mounting of claim 1 in which the ends of each said slot and the ends of each said arm are rounded.

5. A fighting doll with toy prizefight ring which comprises a fighting doll, a toy prizefight ring, said ring having a square planar horizontal floor, four vertically oriented corner posts, and a plurality of horizontally oriented and spaced apart linear rail members, each of said rail members extending between two adjacent ones of said corner posts, the upper end of at least one of said posts having a central vertical cylindrical recess, a horizontal cylindrical rod, a cylindrical sleeve slidably mounted on said rod, said sleeve having a cylindrical protrusion which is slidably fitted vertically downwards into said recess, means at the outer end of said rod to manually grasp said rod, so that said rod may be concomitantly or alternately manually swivelled about said one corner post, rotated about its central horizontal axis, and horizontally displaced inwards or outwards relative to said ring, and means to mount said fighting doll on the inner end of said rod, so that said fighting doll is disposed within said ring and is manually displaceable about substantially the entire upper surface of the floor of said ring and may be concomitantly inclined sideways from a vertically upright orientation.

6. The fighting doll with toy prizefight ring of claim 5 in which the doll has movable limbs, the rod is hollow, a linear shaft extends through the rod, and the means at the outer end of the rod to manually grasp the rod includes means to displace said shaft within the rod alternately towards and away from the fighting doll, the inner end of said shaft being contiguous to and cooperating with means within the fighting doll so that at least one said limb of the fighting doll is moved when said shaft is displaced alternately towards and away from the fighting doll.

7. The fighting doll with toy prizefight ring of claim 6 in which said limbs include two legs and the means within the fighting doll moves the two legs of the fighting doll.

8. The fighting doll with toy prizefight ring of claim 6 in which said limbs include two arms and the means within the fighting doll moves the two arms of the fighting doll.

9. The fighting doll with toy prizefight ring of claim 5 in which the upper end of each of the four corner posts is provided with a central vertical cylindrical recess.

* * * * *